US005456320A

United States Patent [19]

Baker

[11] Patent Number: 5,456,320

[45] Date of Patent: Oct. 10, 1995

[54] CASING SEAL AND SPOOL FOR USE IN FRACTURING WELLS

[75] Inventor: Dwight Baker, Rush Springs, Okla.

[73] Assignee: Total Tool, Inc., Rush Springs, Okla.

[21] Appl. No.: 163,239

[22] Filed: Dec. 6, 1993

[51] Int. Cl.[6] ..... E21B 33/068

[52] U.S. Cl. ..... 166/377; 166/379; 166/380; 166/382; 166/387

[58] Field of Search ..... 166/377–382, 166/387

[56] References Cited

U.S. PATENT DOCUMENTS

| | | | |
|---|---|---|---|
| 2,134,311 | 10/1938 | Minor et al. | 166/379 |
| 3,289,765 | 12/1966 | Hynes | 166/379 |
| 3,561,531 | 2/1971 | Miller | 166/382 X |
| 3,738,426 | 6/1973 | Drouin | 166/379 X |
| 4,326,587 | 4/1982 | Gauthier et al. | 166/379 |
| 5,114,158 | 5/1992 | Le | 166/88 X |

*Primary Examiner*—Roger J. Schoeppel

*Attorney, Agent, or Firm*—Dunlap & Codding

[57] ABSTRACT

A casing seal and casing spool for providing a high pressure seal of the casing pipe of a well during fracturing operations. The casing seal includes a sleeve, a pressure-reactive ring seal, a retainer ring, a split ring and a lock ring. The sleeve has a center bore and a counter bore which is shaped to fit the end of a casing pipe. The retainer ring has an upper recess to accommodate deformation of the ring seal as the ring seal reacts to high pressure. Assembled from four split ring members, the split ring has an upper lip for insertion into an annular groove in a bore and a lower ring recess to accommodate the lock ring. The lock ring is secured in the ring recess of the split ring with threaded fasteners. The casing spool includes an upper flange, a lower flange, a center bore extending between the flanges, an upper counter bore and a lower counter bore. The counter bores of the casing spool are shaped to receive the casing seal and an annular groove is provided in the lower counter bore to receive the lip of the split ring. The protrusion of the split ring lip into the annular groove holds the casing seal in the counter bores and the lock ring secures the assembly of the split ring.

6 Claims, 4 Drawing Sheets

CASING SEAL AND SPOOL FOR USE IN FRACTURING WELLS

BACKGROUND OF THE INVENTION

1. Field of the Invention

The present invention relates generally to devices and seals installed in oil and gas wells for servicing such wells and particularly, but not by way of limitation, to a device and seal for performing fracturing operations on wells.

2. Description of Related Art

In normal operation, a typical oil and gas well may have a production pressure of about 1,500 psi, which is a relatively low pressure. Accordingly, production flow is adequately sealed by a low-pressure tubing head and O-ring seals or compressed rubber seals, or injected plastic seals.

Certain well-servicing operations are performed, however, at higher pressures. In a typical fracturing operation, for example, acids or other fracturing fluids and solids may be pumped into the well at pressures up to 15,000 psi.

Low-pressure tubing heads, conventional O-ring seals and seal retainers are not designed to withstand such high pressures. Therefore, fracturing fluids are likely to leak past conventional O-ring seals, seal retainers and tubing heads.

The leak of fracturing fluids poses an environmental problem. If the acids or other fracturing fluids are not contained, they will enter and contaminate the fresh water zone of the well.

Damage of conventional seals during fracturing operations poses a long term problem resulting in leakage of oil and gas from casing seals. Having leaked past the casing seals, the oil and gas migrates through the casing hangers into the surface pipe and then into shallow water sands.

The leakage of fracturing fluids also causes maintenance problems. The fracturing fluids carry sand and other abrasive material which accelerate wear on valves and other components if allowed to reach those components.

SUMMARY OF THE INVENTION

The present invention is a casing seal and spool which prevents leakage of fracturing fluids under relatively high pressure, such as 3,000 to 15,000 pounds. The casing seal comprises a sleeve, a pressure-influenced ring seal, a retainer ring, a split ring and a lock ring. The split ring includes a lip which protrudes radially from the split ring.

The casing spool includes an upper flange, a lower flange and a center bore extending from the upper flange to the lower flange. The center bore of the casing spool is shaped to matingly receive the casing seal. Furthermore, the center bore has an annular groove for receiving the split ring lip to secure the casing seal within the center bore of the casing spool.

One object of the present invention is to provide a device which seals to contain fracturing fluids under high pressure within the casing pipe of a well.

Another object of the present invention is to provide a high pressure device which may be installed in place of a low pressure tubing head during fracturing operations on a well.

Yet another object of the present invention is to provide a device which may be utilized with a low pressure tubing head or a high pressure casing spool to sealingly contain fracturing fluids under high pressure within the casing pipe of a well.

Other objects, features and advantages of the present invention are apparent from the following detailed description when read in conjunction with the accompanying drawings and appended claims.

DETAILED DESCRIPTION OF THE PREFERRED EMBODIMENTS

Figure 1:
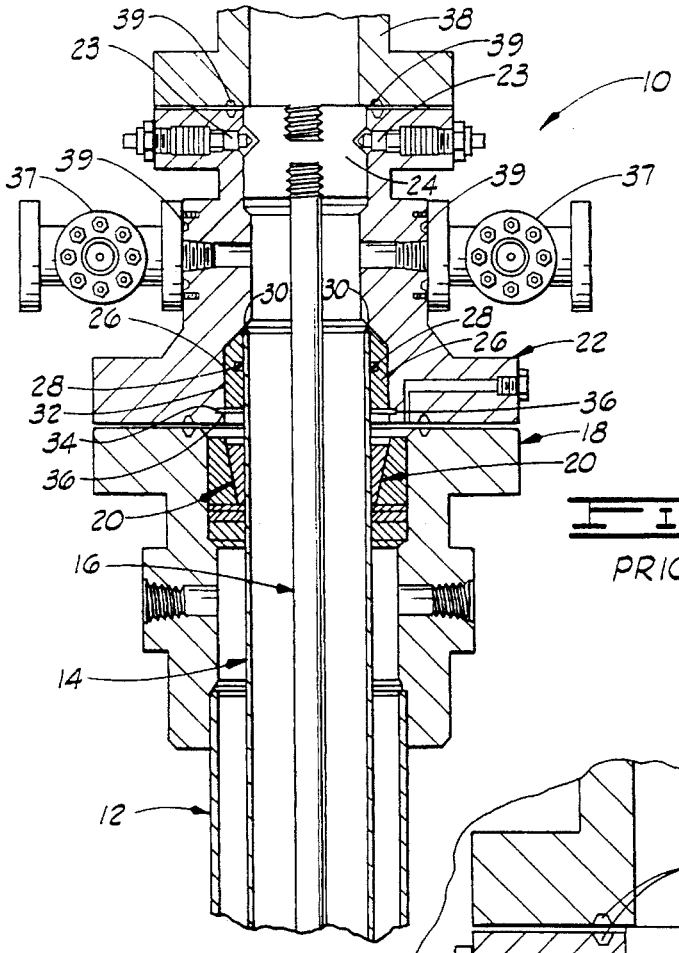
FIG. 1 PRIOR ART
FIG. 1 is partly sectional, elevational view of a portion of a prior art well.

Referring now to FIG. 1, shown therein and designated by reference numeral 10 is a portion of a prior art oil and gas well. The well 10 includes a string of surface pipe 12, a string of casing pipe 14 and a string of tubing 16.

A casing head 18 is provided for suspending the casing pipe 14 in the well 10. A set of casing slips 20 are located in the casing head 18 to grip and hold the casing pipe 14 in place.

A tubing head 22 is connected to the casing head 18 for suspending the tubing 16 within the casing pipe 14. A set of lockdown pins 23 extend into the tubing head 22 to hold a tubing hanger 24 in the tubing head 22 when pressure in the casing 14 is exerted through the casing 14 on the tubing hanger 24.

An O-ring sleeve 26 and an O-ring seal 28 are fitted around the upper end 30 of the casing pipe 14. In normal operation, the production pressure of the well 10 may be about 3,000 pounds, a relatively low pressure. Accordingly, the tubing head 22, O-ring sleeve 26 and O-ring seal 28 are typically rated to withstand pressures under 5,000 psi.

The tubing head 22 typically has a counter bore 32 sized and shaped to receive the O-ring sleeve 26. In order to hold the O-ring sleeve 26 in the tubing head counter bore 32, an annular groove 34 is provided in the counter bore 32 to receive a snap ring 36. The protrusion of the snap ring 36 into the annular groove 34 secures the O-ring sleeve 26 within the tubing head counter bore 32.

Various valves or fittings may be connected to the tubing head 22 for production operation and servicing of the well 10. For example, valve bodies 37 and valve body 38 are connected to the tubing head 22 in FIG. 1. It should be appreciated that connections between the components described herein are sealed by elastomeric ring seals or the like in a conventional manner. Grooves for the installation of such seals are generally designated herein by reference numeral 39.

The surface pipe 12 extends deep enough into the ground to protect the fresh water zone around the well 10. The casing pipe 14, on the other hand extends all the way into the producing zone of the well 10.

The well 10 is operated in any conventional manner. In a typical situation, the casing pipe 14 is perforated in the producing zone. A pump at the end of a rod string is reciprocated in the tubing 16 to create pressure to draw hydrocarbons from the producing zone into the casing pipe 14 through the casing perforations and to the surface within the annulus between the tubing 16 and the casing pipe 14.

Over time, the casing perforations may become blocked and production is curtailed or even stopped. When this occurs, the casing perforation must be unblocked in order to re-establish production.

Two operations for unblocking the casing perforations and creating permeability from the well bore into the oil or gas deposits are fracturing and acidizing. In the narrow sense, fracturing consists of pumping proppant material into the formation to increase the flow of the production zone into the casing pipe 14. Broadly speaking, however, fracturing may include pumping various types of fracturing fluids under pressure into the casing pipe 14.

Narrowly defined, acidizing means pumping acids under pressure into the production zone of the casing pipe 14 to dissolve and flush materials from the casing perforations.

As used herein, the term "fracturing" is defined in the broadest sense to mean either one, or both, of these fracturing operations performed on wells. It should be appreciated, however, that the present invention is not limited to use in fracturing operations, but may be utilized in any suitable operation where a reliable, high pressure seal is required.

Figure 2:
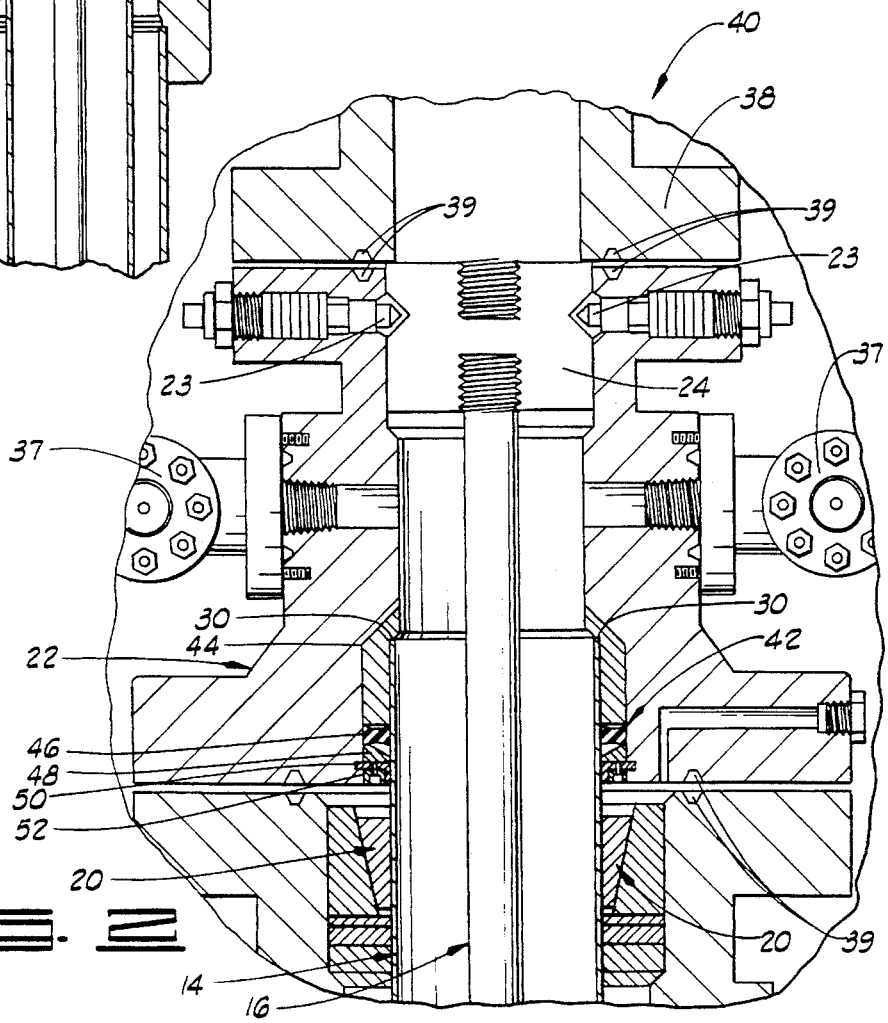
FIG. 2 is a partly sectional, elevational view of a portion of a well with a casing seal constructed in accordance with the present invention.

With reference now to FIG. 2, shown therein and designated by reference numeral 40 is a portion of a well with a casing seal 42 constructed in accordance with the present invention. It should be appreciated that the well 40 is exactly like the prior art well 10, except that the casing seal 42 is substituted for the O-ring sleeve 26 and O-ring seal 28 of the well 10.

Figure 3:
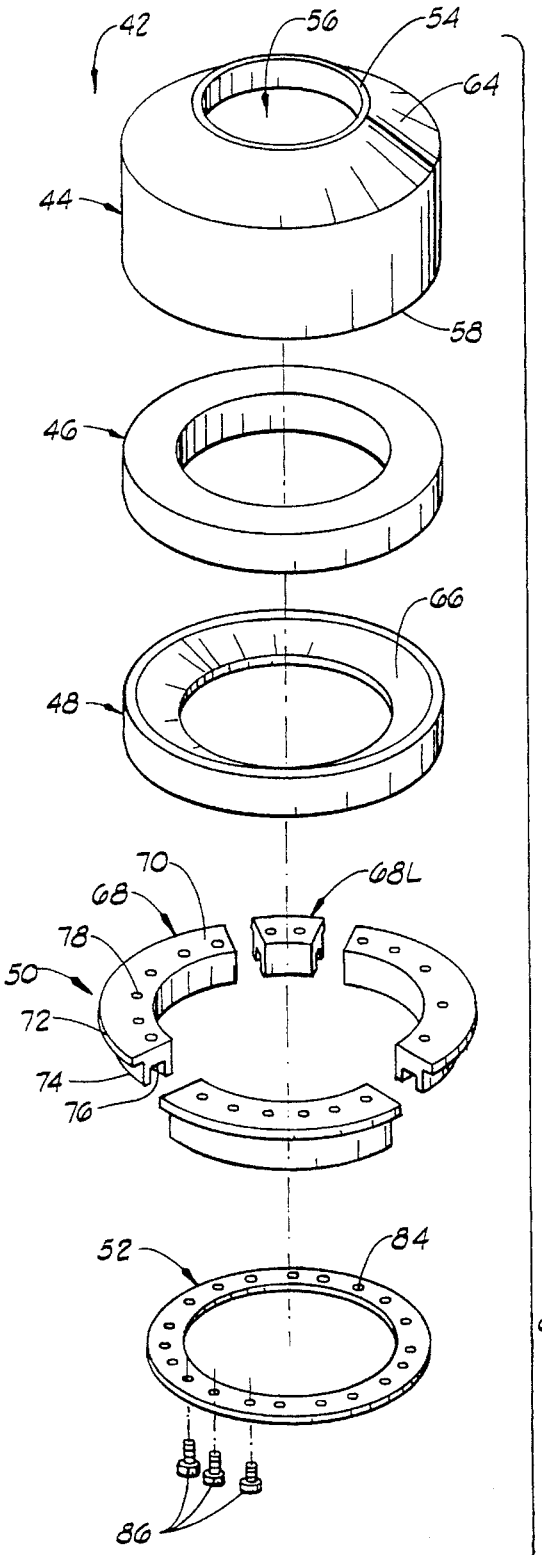
FIG. 3 is an exploded, perspective view of the casing seal shown in FIG. 2.
Figure 4:
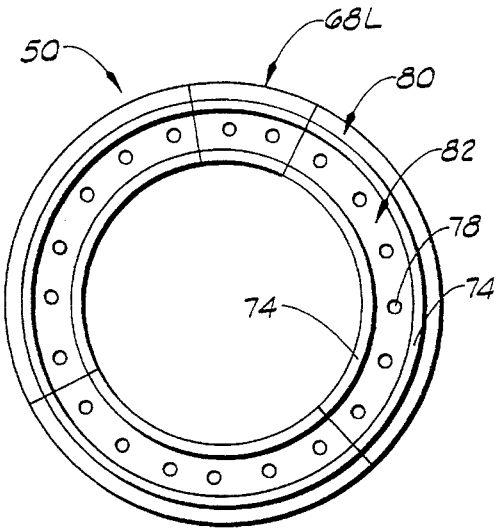
FIG. 4 is a bottom plan view of the split ring shown in FIG. 3.
Figure 5:
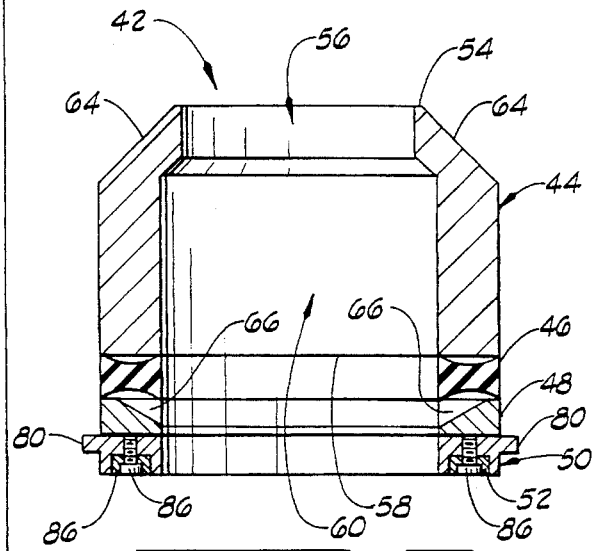
FIG. 5 is an assembled, sectional view of the casing seal of FIG. 3.

Turning now to FIGS. 3 through 5, shown therein is the casing seal 42 separately. The casing seal 42 includes a casing sleeve 44, a pressure-influenced elastomeric ring seal 46, a retainer ring 48, a split ring 50 and a lock ring 52.

As best seen in FIG. 5, upper end 54 of the casing sleeve 44 has a center bore 56 and the lower end 58 has a counter bore 60. The center bore 56 allows fluid communication through the casing sleeve 44 with the casing pipe 14 and the counter bore 60 is sized to fittingly receive the upper end 30 of the casing pipe.

The outer periphery of the casing sleeve 44 includes an upper reducing diameter area 64. With this shape, the casing sleeve 44 fits into an upper portion of the counter bore 32 of the tubing head 22.

The elastomeric ring seal 46 is a seal which is influenced by the pressure to which it is subjected. As the pressure on the ring seal 46 increases, the ring seal 46 deforms to seal more tightly around the casing pipe 14. Such ring seals 46 are capable of withstanding pressures up to 15,000 psi. Ring seals of this type are commercially available and well known in the art.

The retainer ring 48 is basically a tubular cylinder with an upper frustoconical recess 66. When assembled with the ring seal 46 as shown in FIG. 5, the ring seal 46 is allowed to deform into the frustoconical recess 66 of the retainer ring 48.

The split ring 50 comprises a plurality of split ring members. In a typical arrangement, the split ring 50 is made up of four split ring members, one of which is designated by reference numeral 68 and is generally representative of the split ring members.

Each split ring member 68 has a substantially flat upper end 70 and a lip 72 which protrudes radially from the upper end 70 of each split ring member 68. In addition, each split ring member 68 has a lower end 74 with a ring channel 76 adapted to receive a sector of the lock ring 52.

A plurality of threaded holes extend through each split ring member 68 from the upper end 70 into the ring channel 76. One of the threaded holes is designated by reference numeral 78 and is generally representative of the threaded holes through each split ring member 68.

It should be appreciated that, when assembled together as shown in FIG. 4, the split ring members 68 form a ring with an upper radial lip 80 for protruding into an annular groove and a ring recess 82 shaped to receive the lock ring 52. In addition, a lesser one of the split ring members typically accounts for a smaller sector of the split ring 50 than the other split ring members 68. In FIGS. 3 and 4, the lesser split ring member is indicated by reference character 68L.

The lock ring 52 is simply a ring having a plurality of holes therethrough. One of the holes through the lock ring is designated by reference numeral 84 and is generally representative of the lock ring holes. Each hole 84 in the lock ring 52 is located to align with a corresponding one of the threaded holes 78 of the split ring 50. The lock ring 52 may be secured within the ring recess 82 of the assembled split ring 50 by screwing a threaded fastener 86 through each hole 84 of the lock ring 52 and into a corresponding threaded hole 78 of the split ring 50.

With reference to FIG. 5, the assembled casing seal 42 is shown therein. It should be appreciated that the casing sleeve 44 is rated at up to 15,000 psi and that the ring seal 46 is designed for up to 15,000 psi. Accordingly, the casing seal 42 provides a high pressure seal (up to 15,000 psi) around the upper end 30 of the casing pipe 14 (FIG. 2).

OPERATION WITH TUBING HEAD

In order to utilize the casing seal 42 with the tubing head 22 shown in FIGS. 1 and 2, the tubing head 22 is disconnected from the casing head 18 and the snap ring 36 and O-ring sleeve 26 are removed.

The casing sleeve 44, the ring seal 46 and the retainer ring 48 are inserted into the counter bore 32 of the tubing head 22. Reserving the lesser split ring member 68L, the other split ring members 68 are inserted into the counter bore 32 of the tubing head 22 with the lips 72 of each split ring member 68 protruding into the annular groove 34 of the tubing head counter bore 32. It may be necessary to widen the annular groove 34 of the tubing head counter bore 32 to be large enough to receive the lips 72 of the split ring members 68.

Then the lesser split ring member 68L is inserted into the tubing head counter bore 32 to complete the assembled split ring 50. The lock ring 52 is attached within the ring recess 82 of the split ring 50 with threaded fasteners 86 to secure the casing seal 42 within the tubing head counter bore 32.

The protrusion of the split ring lip 80 into the annular groove 34 of the counter bore 32 holds the split ring 50, the retainer ring 48, the ring seal 46 and the casing sleeve 44 within the tubing head counter bore 32. The attachment of the lock ring 52 to the split ring 50 maintains the split ring 50 in the assembled position.

The tubing head 22 is then re-attached to the casing head 18, as shown in FIG. 2. With the casing seal 42 installed in the tubing head 22, the connection between the upper end 30 of the casing pipe 14 and the casing seal 42 is sealed to withstand pressures up to 15,000 psi.

EMBODIMENT OF FIGS. 6 THROUGH 13

Figure 6:
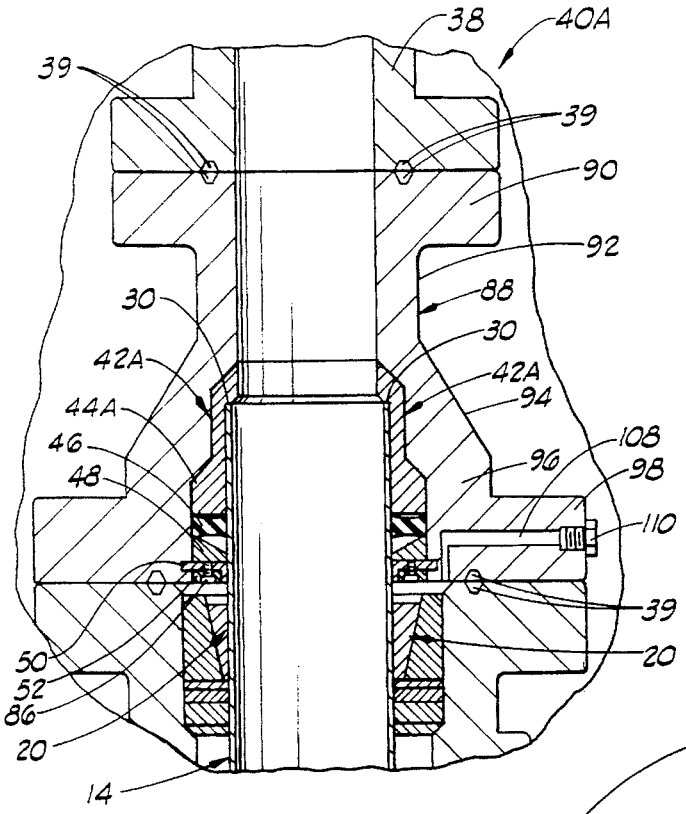
FIG. 6 is partly sectional, elevational view of a portion of a well with a casing spool and casing seal constructed in accordance with the present invention.

Turning now to FIG. 6, shown therein and designated by reference character 40A is a portion of a well with a casing spool 88 and modified casing seal 42A installed for a fracturing operation. It should be appreciated that the tubing 16 and the tubing head 22 are removed from the well 40A and replaced by the casing spool 88 and casing seal 42A.

By replacing the tubing head 22 with the casing spool 88, the entire casing pipe 14 bore may be used in servicing the well 40A. In addition, by replacing the low pressure tubing head 22 with the high pressure casing spool 88, the fracturing operation may be carried out at high pressure without the risk of leakage.

Figure 7:
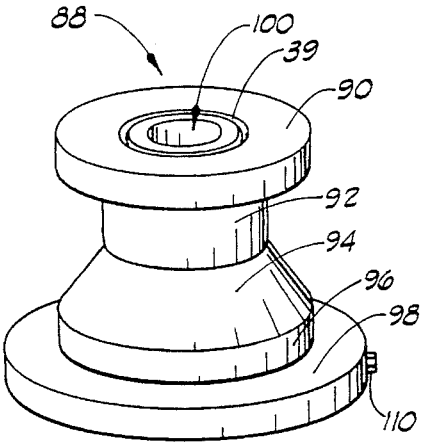
FIG. 7 is a perspective view of the casing spool of FIG. 6.
Figure 9:
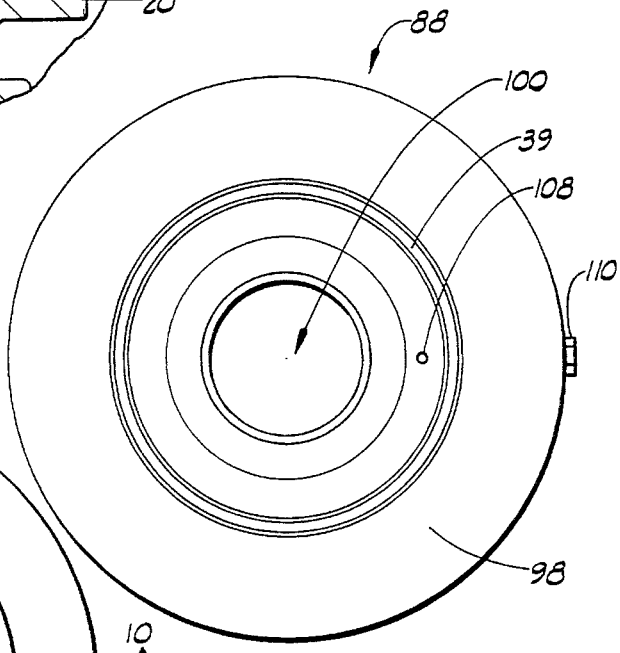
FIG. 9 is a bottom plan view of the casing spool shown in FIG. 7.
Figure 8:
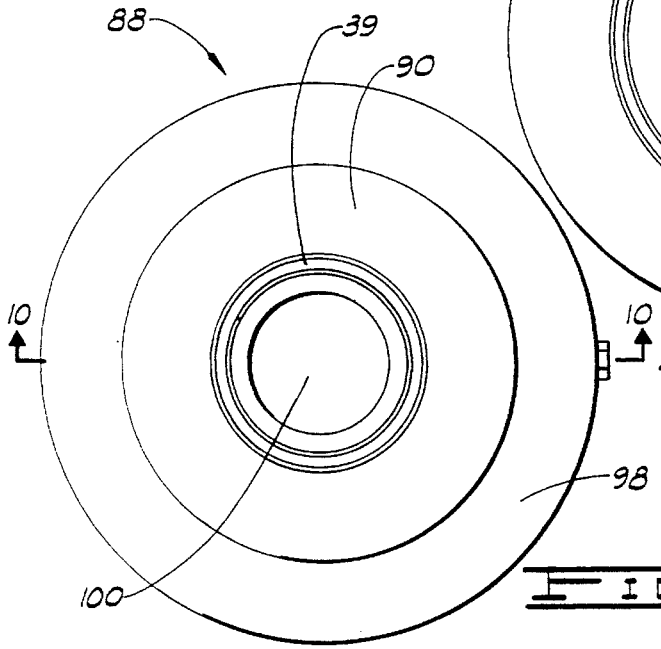
FIG. 8 is a top plan view of the casing spool shown in FIG. 7.

Referring to FIGS. 7 through 10, the casing spool 88 is shown separately. As best seen in FIG. 7, the casing spool 88 has an upper flange 90, an upper cylindrical portion 92, a medial frustoconical portion 94, a lower cylindrical portion 96, and a lower flange 98. A center bore 100 extends through the casing spool 88 from the upper flange 90 to the lower flange 98.

Figure 10:
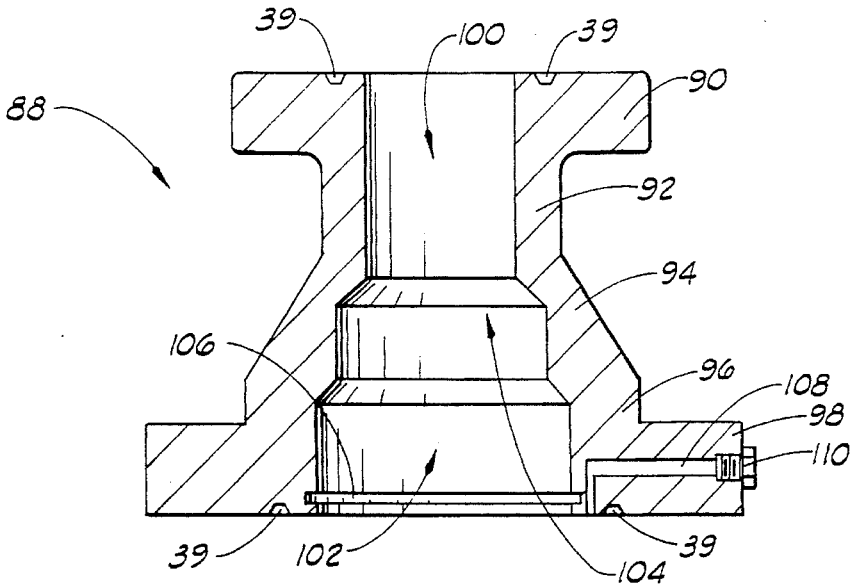
FIG. 10 is a sectional view of the casing spool taken along the lines 10—10 of FIG. 8.

As best illustrated by FIG. 10, a lower counter bore 102 extends into the casing spool 88 from the lower flange 98 and an upper counter bore 104 is provided between the lower counter bore 102 and the center bore 100. Toward the lower end of the lower counter bore 102, an annular groove 106 extends radially from the lower counter bore 102 into the casing spool 88. It should be appreciated that the annular groove 106 of the casing spool 88 is located and shaped to fittingly receive the lip 80 of the split ring 50.

As best shown in FIG. 10, a test bore 108 extends from the side of the lower flange 98 to the bottom of the lower flange 98. The test bore 108 has a threaded opening for attaching a threaded plug 110 to close the test bore 108 when the test bore 108 is not being utilized for testing purposes. As best illustrated by FIG. 6, the test bore 108 allows testing for fluid and pressure between the casing spool 88 and the casing head 18.

It should be appreciated that the entire casing spool 88 may be constructed for high pressure, that is, to withstand pressures in the range of 3,000 to 15,000 psi. Alternatively, the casing spool 88 may be constructed for high/low pressure.

For high/low pressure construction, an upper portion of the casing spool 88 (the portion above the elastomeric ring seal 46 in FIG. 6) is built to withstand 3,000 to 15,000 psi. On the other hand, a lower portion of the casing spool 88 (the portion below the ring seal 46 in FIG. 6) is designed for pressure under 3,000 psi.

Figure 11:
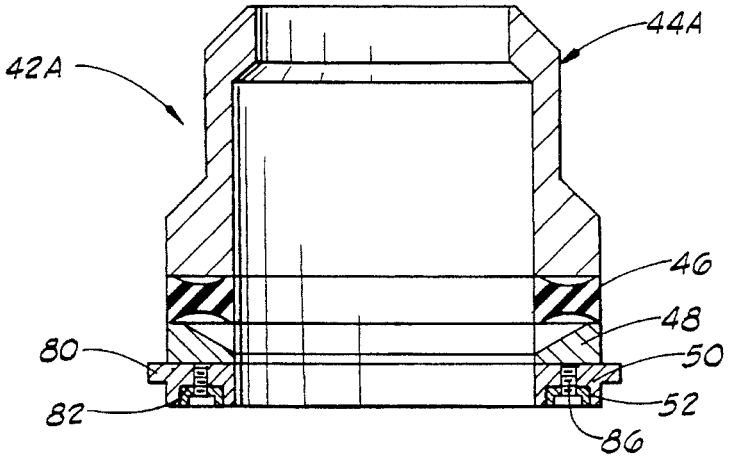
FIG. 11 is a sectional view of the assembled casing seal of FIG. 10.

With reference now to FIG. 11, the modified casing seal 42A is shown separately. The casing seal 42A is exactly like the casing seal 42, except a modified casing sleeve 44A is substituted for the casing sleeve 44.

Figure 12:
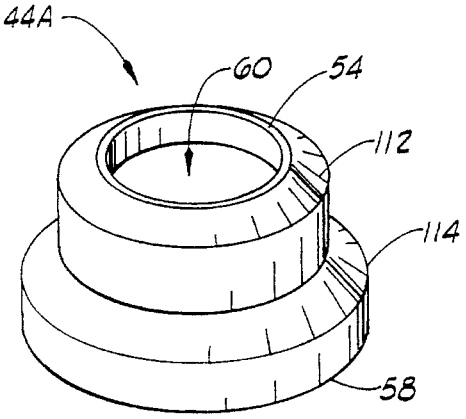
FIG. 12 is a perspective view of the casing sleeve shown in FIG. 11.
Figure 13:
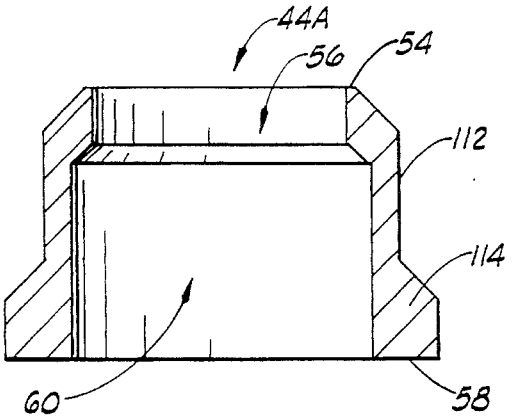
FIG. 13 is a sectional view of the casing sleeve of FIG. 12.

As illustrated by FIGS. 12 and 13, the casing sleeve 44A has an upper portion 112 shaped to mate with the upper counter bore 104 of the casing spool 88 and a lower portion 114 shaped to mate with the lower counter bore 102 of the casing spool 88.

As best illustrated by FIG. 13, the center bore 56 and the counter bore 60 of the casing sleeve 44A are exactly like those of the casing sleeve 44. The center bore 56 of the casing sleeve 44A is adapted to match up with the center bore 100 of the casing spool 88 and the counter bore 60 of the casing sleeve 44A is sized and shaped to matingly receive the open upper end 30 of the casing pipe 14 of the well 40A.

OPERATION WITH CASING SPOOL

Utilizing the casing seal 42A with the casing spool 88 for fracturing operations is very similar to that described hereinabove for use of the casing seal 42 with the tubing head 22. The assembly of the casing seal 42A with the casing spool 88 is the same as that of the casing seal 42 with the tubing head 22.

As mentioned previously, the tubing 16 and tubing head 22 are removed and the casing spool 88 and casing seal 42A are installed in place of the tubing head 22. Accordingly, the entire cross-sectional area of the casing pipe 14 is available for fracturing operations at high pressures when the casing spool 88 and casing seal 42A are employed.

By using the casing spool 88 and casing seal 42A in place of the tubing head 22 during fracturing operations, the tubing head 22, valves 37, connections and components are spared exposure to acids, sand and other damaging materials of fracturing operations. Accordingly, the tubing head 22 and associated components last longer through the use of the casing spool 88 and casing seal 42A during fracturing operations.

Changes may be made in the combinations, operations and arrangements of the various parts and elements described herein without departing from the spirit and scope of the invention as defined in the following claims.

For example, it should be appreciated that either casing seal 42 or 42A may be utilized with either a tubing head or a casing spool. It is only necessary that the tubing head or casing spool be provided with the center bores and counter bores to mate with the casing sleeve 44 or 44A.

What is claimed is:

1. In a method for fracturing a subterranean formation by introducing a fracturing fluid into the subterranean formation at a predetermined pressure through a casing of a well wherein the casing is suspended from a casing head having a pressure rating less than the pressure of the fracturing fluid and wherein a tubing head having a pressure rating less than the pressure of the fracturing fluid is connected to the casing head, the casing having an upper end of the casing extending above the casing head and into the tubing head, the improvement comprising the steps of:

providing a casing spool having an upper end portion, a lower end portion, and a spool bore extending between the upper end portion and the lower end portion thereof, at least the upper end portion having a pressure rating greater than the pressure of the fracturing fluid, the spool bore including a counterbore portion in the lower end portion of the casing spool;

securing a seal member in the counterbore of the casing spool such that the seal member is sealingly disposable between the casing spool and the upper end of the casing to form a fluid-tight seal having a pressure rating greater than the pressure of the fracturing fluid;

removing the tubing head from the casing head;

disposing the casing spool having the seal member secured therein over the upper end of the casing such that the upper end of the casing extends through the seal member;

attaching the lower end of the casing spool to the casing head so as to form a fluid-tight seal between the upper end of the casing and the casing head and provide a pressure upgrade between the casing head and the upper end of the casing;

fracturing the subterranean formation by injecting the high pressure fracturing fluid through the spool bore of the casing spool and the casing at the predetermined pressure;

removing the casing spool from the casing head after completion of the fracturing of the subterranean formation; and re-attaching the tubing head to the casing head.

2. The improvement of claim 1 wherein the casing head and the tubing head each has a pressure rating in a range of about 3,000 to 5,000 psi, wherein the sealing member and the upper end portion of the casing spool each has a pressure rating of at least 15,000 psi, and wherein the fracturing fluid is injected through the casing spool at a pressure equal to or less than 15,000 psi.

3. The improvement of claim 1 wherein the step of securing the seal member in the casing spool comprises the steps of:

providing the casing spool with an internal annular groove extending from the counterbore portion into the casing spool;

disposing a sleeve into the counterbore portion of the spool bore of the casing spool, the sleeve having an upper end, a lower end and a sleeve bore extending between the lower end and the upper end thereof, the sleeve bore dimensioned to receive the upper end of the casing;

positioning the seal member adjacent the lower end of the sleeve such that the seal member is sealingly disposable between the casing spool and the upper end of the casing;

disposing a seal retainer ring adjacent the seal member, the seal retainer ring having a lower surface and an upper surface;

providing a plurality of split ring members, each of the split ring members having an upper surface, a lower surface and an outwardly extending lip dimensioned to fit into the internal annular groove of the casing spool;

disposing the split ring members adjacent the lower surface of the seal retainer ring such that the outwardly extending lip of each of the split ring members is disposed in the internal annular groove of the casing spool, the split ring members cooperating to form a split ring having an inner diameter dimensioned to receive the upper end of the casing; and securing the split ring members together thereby securing the sleeve, the seal member and the seal retainer ring in the casing spool.

4. The improvement of claim 3 wherein the step of securing the split ring members together comprises the steps of:

providing each of the split ring members with a ring channel in the lower surface thereof and a plurality of threaded holes;

disposing a lock ring having a plurality of holes into the ring channel of split ring members such that the holes of the lock ring align with the threaded holes of the split ring members; and securing the lock ring to the split ring members with a plurality of threaded fasteners thereby securing the split ring members together and securing the sleeve, the seal member, and the seal retainer ring in the casing spool.

5. In a method for fracturing a subterranean formation by introducing a fracturing fluid into the subterranean formation at a predetermined pressure through a casing of a well wherein the casing is suspended from a casing head having a pressure rating less than the pressure of the fracturing fluid and wherein a tubing head having a pressure rating less than the pressure of the fracturing fluid is connected to the casing head, the casing having an upper end of the casing extending above the casing head and into the tubing head, the improvement comprising the steps of:

providing a casing spool having an upper end portion, a lower end portion, and a spool bore extending between the upper end portion and the lower end portion thereof, at least the upper end portion having a pressure rating greater than the pressure of the fracturing fluid, the spool bore including a counterbore portion in the lower end portion of the casing spool, the casing spool having an internal annular groove extending from the counterbore portion into the casing spool;

disposing a sleeve into the counterbore portion of the spool bore of the casing spool, the sleeve having an upper end, a lower end and a sleeve bore extending between the lower end and the upper end thereof, the sleeve bore dimensioned to receive the upper end of the casing;

positioning a seal member adjacent the lower end of the sleeve such that the seal member is sealingly disposable between the casing spool and the upper end of the casing to form a fluid-tight seal having a pressure rating greater than the pressure of the fracturing fluid;

disposing a seal retainer ring adjacent the seal member, the seal retainer ring having a lower surface and an upper surface;

providing a plurality of split ring members, each of the split ring members having an outwardly extending lip dimensioned to fit into the internal annular groove of the casing spool;

disposing the split ring members adjacent the lower surface of the seal retainer ring such that the outwardly extending lip of each of the split ring members is disposed in the internal annular groove of the casing spool, the split ring members cooperating to form a split ring having an inner diameter dimensioned to receive the upper end of the casing;

securing the split rings together thereby securing the sleeve, the seal member and the seal retainer ring in the casing spool;

removing the tubing head from the casing head;

disposing the casing spool having the sleeve, the seal member, and the seal retaining ring secured therein over the upper end of the casing such that the upper end of the casing extends through the split ring, the seal retainer ring, the seal member, and into the sleeve;

attaching the lower end of the casing spool to the casing head so as to form a fluid-tight seal between the upper end of the casing and the casing head and provide a pressure upgrade between the casing head and the upper end of the casing;

fracturing the subterranean formation by injecting the high pressure fracturing fluid through the spool bore of the casing spool and the casing at the predetermined pressure;

removing the casing spool from the casing head after completion of the fracturing of the subterranean formation; and re-attaching the tubing head to the casing head.

6. The improvement of claim 5 wherein the casing head and the tubing head each has a pressure rating in a range of about 3,000 to 5,000 psi, wherein the sealing member and the upper end portion of the casing spool each has a pressure rating of at least 15,000 psi, and wherein the fracturing fluid is injected through the casing spool at a pressure equal to or less than 15,000 psi.

* * * * *